US012235050B2

(12) United States Patent
Viinikkala

(10) Patent No.: US 12,235,050 B2
(45) Date of Patent: Feb. 25, 2025

(54) PLATE HEAT EXCHANGER ARRANGEMENT

(71) Applicant: VAHTERUS OY, Kalanti (FI)

(72) Inventor: Reima Viinikkala, Lokalahti (FI)

(73) Assignee: VAHTERUS OY, Kalanti (FI)

( * ) Notice: Subject to any disclaimer, the term of this patent is extended or adjusted under 35 U.S.C. 154(b) by 219 days.

(21) Appl. No.: 17/916,941

(22) PCT Filed: Mar. 30, 2021

(86) PCT No.: PCT/FI2021/050225
§ 371 (c)(1),
(2) Date: Oct. 4, 2022

(87) PCT Pub. No.: WO2021/205064
PCT Pub. Date: Oct. 14, 2021

(65) Prior Publication Data

US 2023/0152042 A1 May 18, 2023

(30) Foreign Application Priority Data

Apr. 6, 2020 (FI) ..... 20205367

(51) Int. Cl.
*F28D 9/00* (2006.01)
*F28F 9/00* (2006.01)
*F28F 9/22* (2006.01)

(52) U.S. Cl.
CPC ..... *F28D 9/0062* (2013.01); *F28F 9/001* (2013.01); *F28F 9/22* (2013.01)

(58) Field of Classification Search
CPC .... F28D 9/0062; F28D 9/0043; F28D 9/0093; F28D 9/0006; F28F 9/001; F28F 9/22; F28F 3/08
See application file for complete search history.

(56) References Cited

U.S. PATENT DOCUMENTS 3,334,399 A * 8/1967 Teeguarden ..... F28D 9/0056 29/890.039
5,299,633 A * 4/1994 Bruggemann ..... F28D 7/08 62/93
5,845,505 A * 12/1998 Galus ..... F28D 9/0068 62/93

(Continued)

FOREIGN PATENT DOCUMENTS

CN 102620581 8/2014
EP 0 740 949 11/1996

(Continued)

OTHER PUBLICATIONS

International Search Report and Written Opinion of the ISA dated Jun. 30, 2021, for PCT/FI2021/050225, 14 pp.

(Continued)

*Primary Examiner* — Nelson J Nieves
(74) *Attorney, Agent, or Firm* — NIXON & VANDERHYE

(57) ABSTRACT

A plate heat exchanger arrangement, which includes at least a first plate pack and a second plate pack arranged adjacent to each other inside the outer casing, and the first plate pack has a diameter, defined by the outer edges of the heat exchange plates, which is greater than a diameter of the second plate pack.

15 Claims, 2 Drawing Sheets

(56) References Cited

U.S. PATENT DOCUMENTS

| | | | | |
|---|---|---|---|---|
| 7,121,102 | B2 * | 10/2006 | Fijas | B01D 53/265 62/93 |
| 7,762,090 | B2 * | 7/2010 | Lee | B01D 5/009 165/113 |
| 9,021,817 | B2 * | 5/2015 | Hoerner | B23K 31/02 62/291 |
| 9,851,154 | B2 * | 12/2017 | Kim | F28D 9/005 |
| 10,143,962 | B2 * | 12/2018 | Förster | F28F 3/027 |
| 11,426,694 | B2 * | 8/2022 | Nardini | B01D 53/343 |
| 2006/0278377 | A1 * | 12/2006 | Martins | F02B 29/0418 165/140 |
| 2007/0267169 | A1 * | 11/2007 | Acre | F28D 9/0093 165/42 |
| 2007/0271910 | A1 * | 11/2007 | Chanfreau | F02M 26/23 60/320 |
| 2008/0087410 | A1 * | 4/2008 | Muller-Lufft | F02B 29/0462 165/165 |
| 2009/0038778 | A1 * | 2/2009 | Korth | F28D 1/0443 165/104.14 |
| 2011/0272127 | A1 * | 11/2011 | Melo | F28D 9/0062 165/185 |
| 2013/0294977 | A1 * | 11/2013 | Johnston | F28D 9/0093 422/162 |
| 2015/0114817 | A1 * | 4/2015 | Kontu | F25B 39/00 202/180 |
| 2016/0001256 | A1 * | 1/2016 | Fujita | F28D 9/0062 422/198 |
| 2023/0020370 | A1 * | 1/2023 | Enomura | F28D 7/02 |
| 2024/0110750 | A1 * | 4/2024 | Bornemann | F28D 13/00 |

FOREIGN PATENT DOCUMENTS

| | | |
|---|---|---|
| WO | 91/09262 | 6/1991 |
| WO | 2013/150175 | 10/2013 |
| WO | 2015/070201 | 5/2015 |

OTHER PUBLICATIONS

Finnish Search Report dated Nov. 16, 2020, for FI Application No. 20205367, 1 pg.

* cited by examiner

PLATE HEAT EXCHANGER ARRANGEMENT

CROSS-REFERENCE TO RELATED APPLICATION(S)

This application is the U.S. national phase of International Application No. PCT/FI2021/050225 filed Mar. 30, 2021, which designated the U.S. and claims priority to FI 20205367 filed Apr. 6, 2020, the entire contents of each of which are hereby incorporated by reference.

FIELD OF THE INVENTION

The present invention relates to a plate heat exchanger arrangement according to the independent claim presented below. The invention relates also a modular structure comprising a plate heat exchanger arrangement according to the invention.

BACKGROUND OF THE INVENTION

Plate and Shell-type plate heat exchangers are composed of a plate pack formed by heat exchange plates and an outer casing surrounding it, functioning as a pressure vessel. A plate pack is made up of several plate pairs. Each plate pair is typically formed of two heat exchange plates that are attached together at least at their outer periphery. Each heat exchange plate has at least two openings for the flow of a heat exchange medium. Adjacent plate pairs are attached to each other by attaching the openings of two adjacent plate pairs to each other. The inner parts of which plate pairs are arranged in connection with each other via flow passages formed by the openings of the heat exchange plates, wherein a primary circuit of the heat exchanger is formed between the openings in the heat exchange plates. A secondary circuit is formed between connections of the outer casing surrounding the plate pack, and they are arranged in connection with the spaces between the plate pairs of the plate pack. A heat exchange medium of the primary side flows in every other plate space and a heat exchange medium of the secondary side in every other plate space.

In some applications there might be need for several heat exchangers, but a space for the heat exchangers is limited, wherein it may be beneficial if heat exchangers can be arranged as compact as possible.

SUMMARY OF THE INVENTION

It is an object of the present invention to provide a compact plate heat exchanger arrangement comprising at least two plate packs inside the same common outer casing and which plate packs have a common shell side.

It is also an object of the invention to provide a plate heat exchanger arrangement which can be used as a heat exchanger as such, but which can also be utilized in the modular structures.

Further, it is an object of the invention to provide a plate heat exchanger construction which is easy to manufacture.

In order to achieve among others the objects presented above, the invention is characterized by what is presented in the characterizing part of the enclosed independent claim. Some preferred embodiments of the invention will be described in the other claims.

A typical plate heat exchanger arrangement according to the invention comprises at least a first plate pack, and a second plate pack, which first plate pack and second plate pack are formed by heat exchange plates having at least two openings and arranged on top of each other, and the heat exchange plates are attached to each other as plate pairs, the inner parts of which plate pairs are arranged in connection with each other via flow passages formed by the openings of the heat exchange plates, wherein primary circuit of the heat exchanger is formed between the openings in the heat exchange plates, a common outer casing surrounding the first plate pack and the second plate pack, which outer casing comprises a longitudinal cylindrical shell and end plates arranged at both ends of the shell, an inlet and outlet connections of the first plate pack, which are connected with the flow passages of the first plate pack, an inlet and outlet connections of the second plate pack, which are connected with the flow passages of the second plate pack, an inlet connection and an outlet connection for heat exchange medium flowing inside the shell, which connections are arranged through the outer casing, wherein a secondary circuit is formed between connections of the outer casing arranged in connection with the spaces between the plate pairs of the plate pack, and wherein the first and the second plate pack has common shell side in the heat exchanger arrangement for heat exchange medium flowing inside the shell, and in which plate heat exchanger arrangement, the first plate pack and the second plate pack are arranged adjacent to each other inside the common outer casing, and the first plate pack has a diameter, defined by the outer edges of the heat exchange plates, which is greater than a diameter of the second plate pack.

In a typical plate heat exchanger arrangement according to the invention at least two plate packs having different diameters, defined by the outer edges of the heat exchange plates of the plate pack, are arranged adjacent to each other inside the same common outer casing. This arrangement provides more space for arranging inlet and/or outlet connections of the plate packs through the same end plate of the outer casing. Further, when two or more plate packs are arranged inside the same common outer casing, they can divide common shell side in the heat exchanger arrangement. These are advantageous constructions if there is a limited space available for multiple heat exchangers. In a typical embodiment according to the invention the shell side is common in all plate packs of the arrangement. A shell side can be constructed simply without complex structures which e.g. simplify a pipework required for the heat exchanger arrangement according to the invention.

A typical modular structure according to the invention comprises at least two modules arranged inside the same outer casing, which modules are separated from each other by a partition wall, and at least one module is formed of a plate heat exchanger arrangement according to the present invention comprising at least two plate packs.

According to an embodiment of the present invention, a structure of the arrangement according to the present invention provides a completely welded plate heat exchanger arrangement and it does not affect the pressure-tightness of the heat exchanger.

DESCRIPTION OF THE DRAWINGS

The invention will be described in more detail with reference to appended drawings, in which.

DETAILED DESCRIPTION OF THE INVENTION

Figure 1:
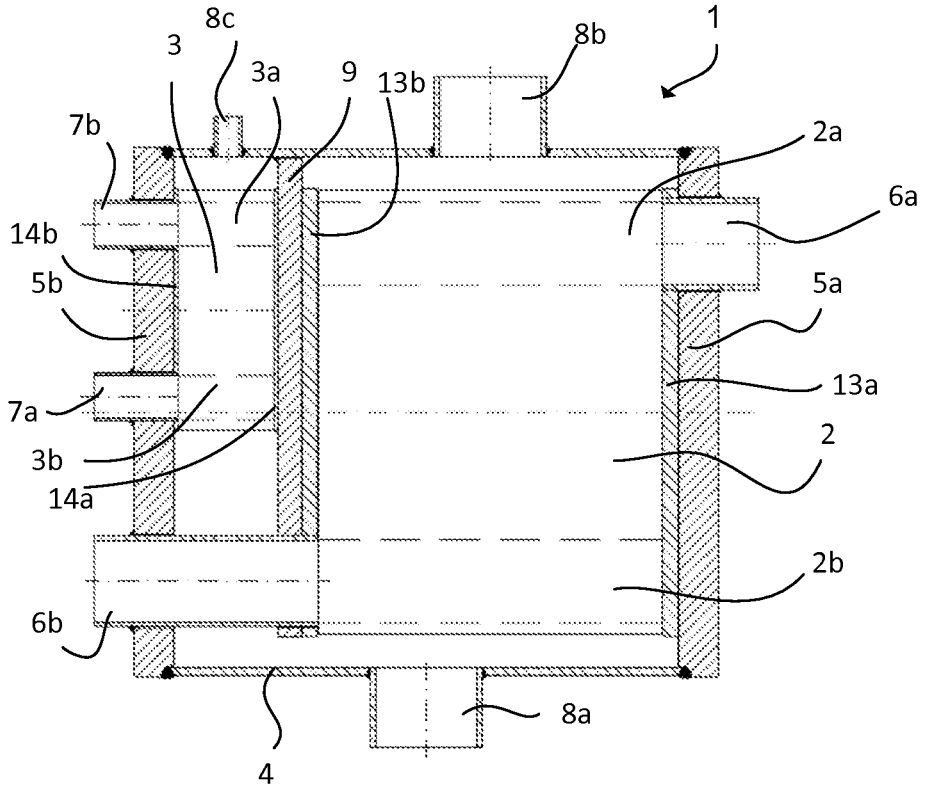
FIG. 1 shows a plate heat exchanger arrangement according to an embodiment of the present invention with two plate packs arranged inside the same common outer casing.

A plate heat exchanger arrangement according to the invention comprises at least two plate packs, a first plate pack and a second plate pack, and an outer casing surrounding them. The outer casing comprises a shell and a first end plate and a second end plate, which end plates are arranged at the ends of the shell. In a typical embodiment according to the invention, the shell is a substantially horizontal cylindrical shell and the end plates are vertical end plates. A longitudinal direction of the outer casing or cylindrical shell is the direction between the end plates of the outer casing, typically it means the horizontal direction. If the cylindrical shell of the outer casing is a straight circular cylinder, then its longitudinal direction is the same as the direction of the central axis of the cylinder in question.

In a plate heat exchanger arrangement according to the present invention, a first plate pack and a second plate pack are formed by heat exchange plates having at least two openings and arranged on top of each other. A plate pack comprises ends at the direction of the heat exchange plates and an outer surface defined by the outer edges of the heat exchange plates. In a preferred embodiment of the invention, both ends of the plate pack comprise a separate support end plate. The plate packs are made up of several plate pairs. Each plate pair is typically formed of two heat exchange plates that are attached together at least at their outer periphery. Each heat exchange plate has at least two openings for a flow of a heat exchange medium. Adjacent plate pairs are attached to each other by attaching the openings of two adjacent plate pairs to each other. The inner parts of which plate pairs are arranged in connection with each other via flow passages formed by the openings of the heat exchange plates. In a plate pack, a heat exchange medium can flow from a plate pair to another via the openings. In an embodiment according to the present invention, heat exchange plates are typically circular heat exchange plates, wherein the plate pack is mainly circular cylinder in shape. A plate pack may also be formed of e.g. semicircle or ellipse heat exchange plates. A longitudinal direction of the plate packs is same as the longitudinal direction of the cylindrical shell.

A common outer casing surrounds the plate packs arranged adjacent to each other inside the outer casing, preferably a common cylindrical shell surrounds the plate packs. In an embodiment of the present invention, a first plate pack and a second plate pack are arranged adjacent to each other inside the same common outer casing, and the first plate pack has a diameter, defined by the outer edges of the heat exchange plates, which is greater than a diameter of the second plate pack.

According to an embodiment of the invention, at least one partition plate is arranged between the first plate pack and the second plate pack. According to an embodiment of the present invention a partition plate, which is arranged in between the adjacent plate packs, has a size which corresponds at least the size of the plate pack having the greater diameter. In an embodiment of the present invention, a partition plate has a size wherein the partition plate is in connection with the inner surface of the outer casing from one edge of the partition plate. The partition plate between the adjacent plate packs makes possible to provide a tight construction with plate packs having a different size, defined by the diameter of the heat exchange plates. In an embodiment of the present invention, a partition plate is arranged to elongate from an outer surface of the plate pack to an inner surface of the shell at one side of the plate pack and so the partition plate forms multiple passes for heat exchange medium in the common shell side of the heat exchanger.

According to an embodiment of the present invention, a partition plate arranged between the adjacent plate packs has a thickness of about 20-100 mm. An intermediate plate will support the structure of the plate packs and improves its pressure resistant.

According to an embodiment of the present invention, a plate heat exchanger arrangement further comprises a third plate pack, wherein inside the same common outer casing is arranged three plate packs adjacent to each other: a first plate pack, a second plate pack and a third plate pack. A third plate pack is also formed from heat exchange plates having at least two openings and arranged on top of each other, as the first and second plate packs. A third plate pack comprises ends at the direction of the heat exchange plates and an outer surface defined by the outer edges of the heat exchange plates, and the heat exchange plates are attached to each other as plate pairs, the inner parts of which plate pairs are arranged in connection with each other via flow passages formed by the openings of the heat exchange plates. According to an embodiment of the present invention, these three plate packs are arranged adjacent to each other inside the same common outer casing, and at least a first plate pack has a diameter greater than the second plate pack and the third plate pack. According to an embodiment of the present invention, the third plate pack has a diameter, defined by the outer edges of the heat exchange plates, which is at least smaller than a diameter of the first plate pack. According to an embodiment of the present invention, the third plate pack has a diameter, defined by the outer edges of the heat exchange plates, which is smaller than a diameter of the first plate pack and the second plate pack. The plate packs can be arranged adjacent to each other in any order inside the outer casing. According to the present invention, at least one plate pack has a greater diameter than other plate packs. In an embodiment according to the present invention, all plate packs arranged adjacent to each other have a different diameter.

When a plate heat exchange arrangement comprises three plate packs, the plate heat exchanger arrangement may also comprise a second partition plate arranged between the third plate pack and the plate pack arranged adjacent thereto. A partition plate is corresponding as the partition plate between the first and the second plate packs defined above. A partition plate has a size which corresponds at least the size of the plate pack having the greater diameter. In a typical embodiment, a partition plate has a size wherein the partition plate is in connection with the inner surface of the outer casing from one edge of the partition plate. In an embodiment of the invention comprising three plate packs adjacent to each other, the middle plate pack is between the partition plates and these partition plates may also define flow channel for heat exchange medium flowing inside the common shell side, i.e. these partition plates elongate from an outer surface of the plate pack to an inner surface of the shell at one side of the plate pack. In an embodiment of the invention, a shell side has one common inlet connection, and outlet connections of the shell side are arranged to the spaces between these partition plates.

A plate heat exchanger arrangement according to the present invention may also comprise more than three plate packs, wherein at least a first plate pack has a diameter greater than other plate packs. The present invention is not only limited to above described arrangements which comprise two or three different sized plate packs. A plate heat exchanger arrangement may also comprise plate packs with similar size, but the present invention is based on at least two different sized plate packs arranged adjacent to each other inside the same common outer casing, and hence providing more space to arrange inlet/outlet connections of the plate pack with the greater diameter to the same end plate of the outer casing as the inlet and outlet connections of the plate pack with smaller diameter.

The plate packs according to the invention may comprise a different amount of the plate pairs. The plate packs may be dimensioned on the basis of the requirement of an application.

A plate heat exchanger arrangement according to the invention comprises an inlet connection and an outlet connection for each plate pack, which connections are connected with the flow channels of said plate pack. The primary circuit of the plate pack is thus formed between the inlet and outlet connection of said plate pack. The inlet and outlet connections of the secondary circuit are arranged through the outer casing in connection with the inner side of the outer casing, in the spaces between the plate pairs. Typically, the primary circuits of the plate packs and the secondary circuit are separate from each other, i.e. the heat exchange medium flowing in the inner part of a plate pack cannot get mixed with the heat exchange medium flowing in the outer casing and with the heat exchange medium flowing in the inner part of another plate pack.

In a plate heat exchanger arrangement of the invention, an inlet and an outlet connection of the first plate pack are arranged to be in connection with the flow passages of the first plate pack. An inlet and outlet connection comprise a connection tube, which is arranged through an end plate of the outer casing and connected with the flow passages of the plate pack. An inlet and outlet connection of the second plate pack, which are arranged to be in connection with the flow passages of the second plate pack, comprises a connection tube, which are arranged through an end plate of the outer casing and connected with the flow passages of the plate pack. Correspondingly, according to an embodiment of the invention a third plate pack comprises an inlet and outlet connections comprising a connection tube, which are arranged through an end plate of the outer casing and connected with the flow passages of the third plate pack.

The adjacent plate packs with different outer diameters make possible to easily arrange an inlet and/or outlet connection of a greater sized plate pack to through the same end plate of the outer casing as the inlet and outlet connection of a smaller sized plate pack. According to an embodiment of the present invention, an inlet and/or outlet connection of the first plate pack is arranged outside of the outer surface of the second plate pack, when the first plate pack has a diameter, defined by the outer edges of the heat exchange plates, which is greater than a diameter of the second plate pack, and/or an inlet and/or outlet connection of the second plate pack is arranged outside of the outer surface of the third plate pack, when the second plate pack has a diameter, defined by the outer edges of the heat exchange plates, which is greater than a diameter of the third plate pack. In a preferred embodiment of the present invention, an inlet connection and/or an outlet connection of the first plate pack, and an outlet connection and an inlet connection of the second plate pack are arranged through the same end plate, wherein the first plate pack has a diameter, defined by the outer edges of the heat exchange plates, which is greater than a diameter of the second plate pack, and an inlet and/or outlet connection of the first plate pack is arranged outside of the outer surface of the second plate pack. Also, in same manner, in an embodiment of the invention comprising three or more plate packs, an inlet and/or outlet connections of each plate pack are preferably arranged through the same end plate.

According to an embodiment of the present invention, an inlet connection and an outlet connection of a plate pack comprise a connection pipe, and they are arranged nested, wherein an outer diameter of inner connection pipe is smaller than a diameter of the outer connection pipe and the flow passage of the plate pack. This enables to arrange an inlet and an outlet connection of the plate pack through same end plate of the outer casing and provides more compact structure. When the inlet and outlet connections are arranged nested and connected to one flow channel of the plate pack, an inlet connection of the plate pack is formed by arranging a connection pipe through an outlet connection of the plate pack, wherein said inlet connection pipe elongates inside the flow passage of said plate pack and outlet connection pipe is attached to the end of the plate pack for forming connection to said flow channel.

According to an embodiment of the present invention a plate heat exchanger arrangement provides a compact structure since the inlet and the outlet connections of the plate packs are possible to arrange through one end plate of the outer casing. This kind of plate heat exchanger arrangement according to the invention can be formed with an openable end plate structure and the plate pack can be easily removed out from the outer casing, if required e.g. for cleaning.

In a plate heat exchanger arrangement of the invention, an inlet connection and an outlet connection for heat exchange medium flowing inside the shell are arranged through the outer casing, typically through the shell of the outer casing. An inlet and an outlet connection of the shell side may be arranged through the end plate(s) or through the shell, or any combination of them. In a preferred embodiment of the present invention, a single heat exchange medium flows inside in the shell side of the plate heat exchanger arrangement, i.e. the shell side is common in all plate packs. According to an embodiment of the invention, a plate heat exchanger arrangement comprises one inlet connection and two outlet connections for a heat exchange medium flowing in a shell side, when the partition plate between the adjacent plate packs divides a shell part to two separate parts in an edge of the outer casing, each part comprises own outlet connection. In an embodiment according to the invention, where the arrangement comprises three plate packs and two partition plates, a plate heat exchanger arrangement may comprise one inlet connection and three outlet connections for a heat exchange medium flowing in a shell side, each part divided by the partition plate comprises own outlet connection.

According to an embodiment of the present invention, a separate stopper plate is arranged between an outer surface of a plate pack and an inner surface of the shell at least to one side of the plate pack for forming multiple passes for heat exchange medium in the shell side of the heat exchanger. According to an embodiment of the invention a stopper plate may be welded to a partition plate arranged between the adjacent plate packs. In an embodiment, a stopper plate is a substantially planar in the direction of the heat exchange plates and it is arranged to the plate heat exchanger structure in the direction of the heat exchange plates of the plate pack.

In a plate heat exchanger according to the present invention the heat exchange mediums may be arranged to flow forward current, counter current or cross flow.

A plate heat exchanger arrangement according to the invention may be a heat exchanger as such, or it may be a part of the modular structure.

A modular structure according to the invention comprises at least two modules arranged inside the same outer casing, which modules are separated from each other by a partition wall, and at least one module is formed of a plate heat exchanger arrangement according to invention comprising at least two plate packs. In an embodiment, the outer casing of the modules is continuous in the length of the modular structure. In a modular structure, a partition wall between the plate heat exchanger arrangement and the adjacent module is the end plate of the outer casing of said plate heat exchanger arrangement. The arrangement according to the invention provides a compact modular structure, since at least two plate packs with heat exchange medium circulations can be arranged inside one module part.

These kinds of the structures may be advantageous when a space for the heat exchanger applications is limited.

DETAILED DESCRIPTION OF THE DRAWINGS

For the sake of clarity, the same reference numbers are used for corresponding parts in different embodiments.

Figure 2:
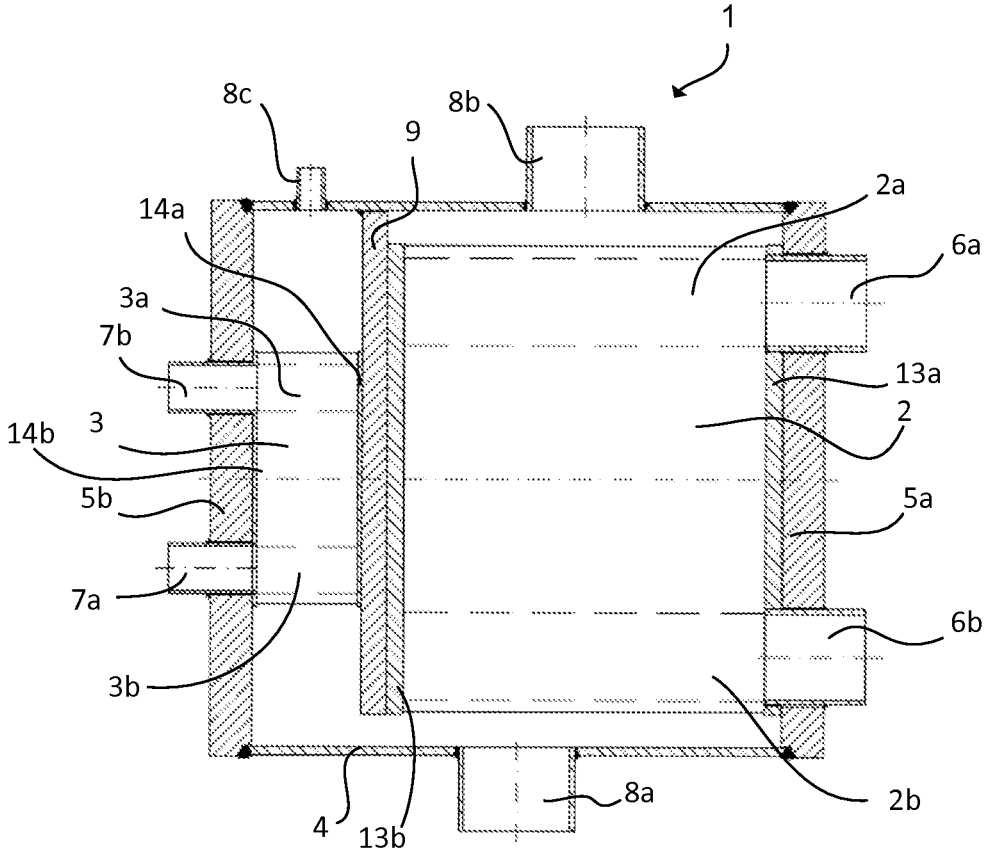
FIG. 2 shows a plate heat exchanger arrangement according to other embodiment of the present invention with two plate packs arranged inside the same common outer casing, and FIG. 3 a plate heat exchanger arrangement according to an embodiment of the present invention with three plate packs arranged inside the same common outer casing.
Figure 3:
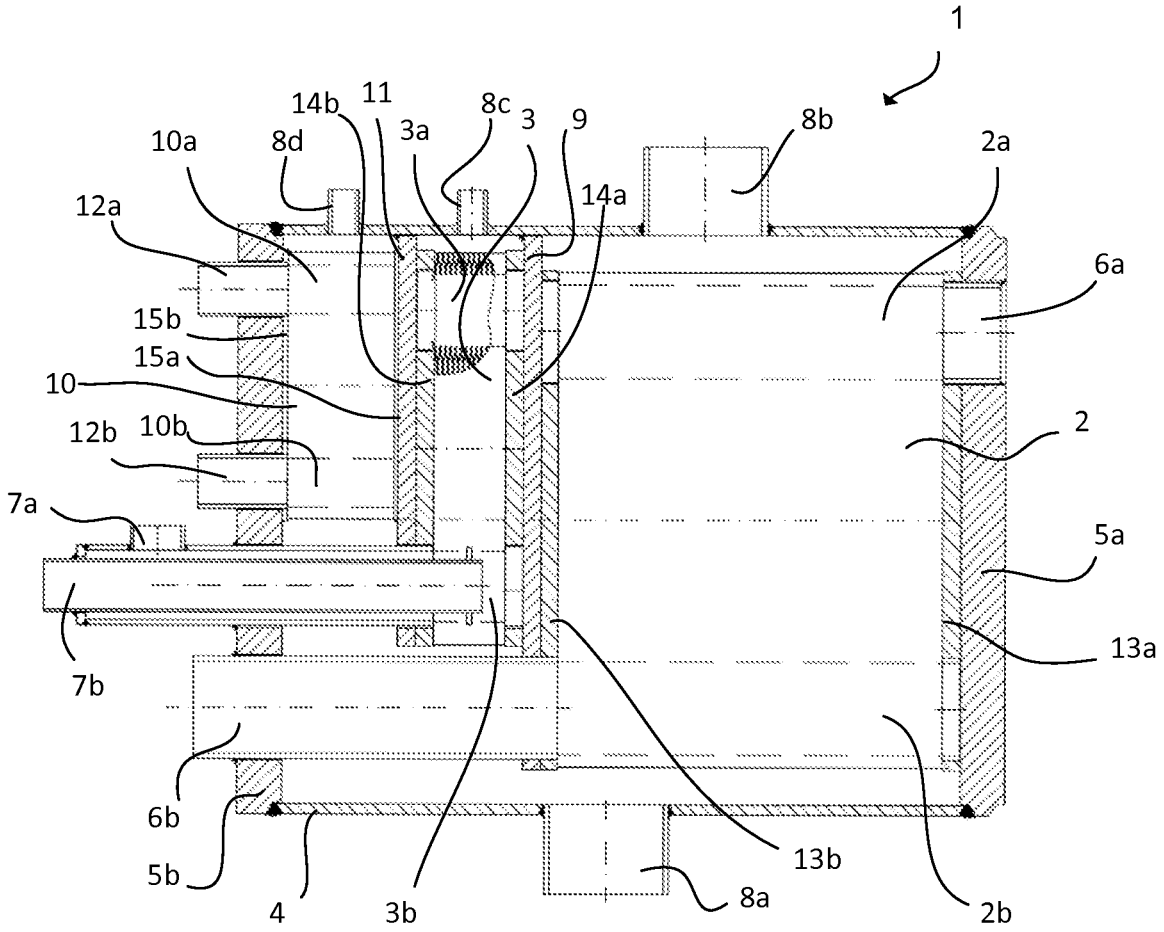

The plate heat exchanger arrangements 1 presented in FIGS. 1-3 comprise an outer casing, which is formed of a substantially horizontal cylindrical shell 4 and substantially vertical first and second end plates 5*a*, 5*b*.

In the FIGS. 1 and 2, a first plate pack 2 and a second plate pack 3 are arranged inside the same common outer casing. The first plate pack 2 and the second plate pack 3 are formed by heat exchange plates having two openings and arranged on top of each other, in which plate packs the heat exchange plates are attached to each other as plate pairs, the inner parts of which plate pairs are arranged in connection with each other via flow passages 2*a*, 2*b*, 3*a*, 3*b* formed by the openings of the heat exchange plates. Each plate pack comprises several plate pairs. A number of the plate pairs may vary and a length of the plate pack in a longitudinal direction of the plate pack may differ from each other. A diameter of the first plate pack 2, defined by the outer edges of the heat exchange plates, is greater than the diameter of the second plate pack 3.

The first plate pack 2 and the second plate pack 3 are arranged adjacent to each other and a partition plate 9 is arranged between the plate packs. As shown in Figures, a partition plate 9 has a size which is greater than a size of the plate pack having the greater diameter so that the partition plate is in connection with the inner surface of the outer casing from one edge of the partition plate, and so the partition plate forms multiple passes for heat exchange medium in the shell side of the heat exchanger. Typically, a partition plate 9 is arranged to at least the whole area of the plate pack having greater diameter.

In FIG. 1, an inlet and outlet connections 6*a*, 6*b* of the first plate pack 2 is arranged through different end plates 5*a*, 5*b* of the outer casing. As shown in FIG. 1, one of the connections 6*b* is arranged outside of the outer surface of the second plate pack 3 and therefore it can be easily arranged through the end plate 5*b* of the outer casing. Hence, the inlet and outlet connections 7*a* and 7*b* of the second plate pack 3 and the outlet connection 6*b* of the first plate pack 2 is arranged through the same end plate 5*b*. It is possible that the inlet and outlet connections 6*a*, 6*b* of the first plate pack 2 are arranged nested and the inner connection pipe elongates at least partly inside the flow channel 2*b* (not shown in FIG. 1). A heat exchange medium circuit of the first plate pack 2 is formed between the inlet and outlet connections 6*a*, 6*b*, a flow direction may be whichever. In FIG. 1, a heat exchange medium circuit of the second plate pack 3 is formed between the inlet and outlet connections 7*a* and 7*b*, a flow direction may be whichever.

In FIG. 2, an inlet and outlet connections 6*a*, 6*b* of the first plate pack 2 are arranged through the same end plate 5*a*. An inlet and outlet connections 7*a*, 7*b* of the second plate pack 3 are arranged through other end plate 5*b* of the outer casing.

In FIGS. 1 and 2, a shell side of plate heat exchanger arrangement comprises one inlet connection 8*a* and two outlet connections 8*b*, 8*c*. The shell side comprises two passes, which are formed by a partition plate 9 arranged between the plate packs.

In an embodiment presented in FIG. 3, a plate heat arrangement 1 comprises three plate packs: a first plate pack 2, a second plate pack 3 and a third plate pack 10. A diameter of the third plate pack 10, defined by the outer edges of the heat exchange plates, is smaller than the diameter of the first plate pack 2 and the third plate pack 3. A diameter of the second plate pack 3 is also smaller than the diameter of the first plate pack 2. The plate packs are separated from each other by arranging partition plates 9, 11 between the plate packs. As shown in FIG. 3, the partition plates 9, 11 elongates to the inner surface of the outer casing at one edge of the partition plates and form multiple passes for heat exchange medium in the shell side of the heat exchanger. The partition plates 9, 11, cover the whole area of the greater sized plate pack to which they are connected. A heat exchange medium circuit of the first plate pack 2 is formed between an inlet and an outlet connections 6*a*, 6*b* same kind as in FIG. 1. An inlet connection 7*a* of the second plate pack 3 is arranged inside the outlet connection 7*b* of the second plate pack, wherein the connections 7*a*, 7*b* are nested and the inner connection 7*a* elongates at least partly inside the flow channel 3*b*. In FIG. 3, a heat exchange medium circuit of the third plate pack 10 is formed between the inlet and outlet connections 12*a*, 12*b*, a flow direction may be whichever. The inlet and outlet connections 12*a*, 12*b* are connected with the flow channels 10*a*, 10*b* of the third plate pack. In FIG. 3, one of the connections of the first plate pack 2 is arranged outside of the outer surface of the second plate pack 3, when the first plate pack has a diameter, defined by the outer edges of the heat exchange plates, which is greater than a diameter of the second plate pack. Further, an inlet and outlet connection 7*a*, 7*b* of the second plate pack 3 is arranged outside of the outer surface of the third plate pack 10, when the second plate pack has a diameter, defined by the outer edges of the heat exchange plates, which is greater than a diameter of the third plate pack. Hence, the inlet or the outlet connection of the first plate pack 2, and the outlet and inlet connections of the second plate pack 3 and the outlet and inlet connections of the third plate pack 10 are arranged through the same end plate 5*b* of the outer casing.

In FIG. 3, a shell side of plate heat exchanger arrangement comprises one inlet connection 8*a* and three outlet connections 8*b*, 8*c*, 8*d*. The shell side comprises three passes for a heat exchange medium flowing inside the shell, which are formed by a partition plates 9, 11 arranged between the plate packs. Outlet connections 8*b*, 8*c*, 8*d* are connected to the shell parts divided by the partition plates 9,11, each part comprises own outlet connection.

In Figures, a first plate pack 2 comprises the support end plates 13*a*, 13*b* at the ends of the plate pack, a second plate pack 3 comprises the support end plates 14*a*, 14*b* and a third plate pack 10 comprises the support end plates 15*a*, 15*b*.

The plate heat exchanger arrangements presented in FIGS. 1-3 may form a plate heat exchanger as such or they may be a part of the modular structure. In modular structures, the plate heat exchanger arrangement presented in FIGS. 1-3 may be one module of the modular structure, and an end plate 5*a* forms a partition wall between the arrangement and the second module of the modular structure.

The invention claimed is:

1. A plate heat exchanger arrangement, comprising:

a first plate pack, and a second plate pack, the first plate pack and the second plate pack being formed by heat exchange plates having at least two openings and disposed on top of each other, the heat exchange plates being attached to each other as plate pairs, inner parts of the plate pairs being arranged in connection with each other via flow passages formed by the at least two openings of the heat exchange plates, a primary circuit of the heat exchanger being formed between the at least two openings in the heat exchange plates;

a common outer casing surrounding the first plate pack and the second plate pack, the outer casing comprising a longitudinal cylindrical shell and end plates disposed at both ends of the shell;

inlet and outlet connections of the first plate pack, which are connected with the flow passages of the first plate pack;

inlet and outlet connections of the second plate pack, which are connected with the flow passages of the second plate pack; and an inlet connection and an outlet connection for a heat exchange medium flowing inside the shell, the inlet and outlet connections for the heat exchange medium being disposed through the outer casing, a secondary circuit being formed between connections of the outer casing arranged in connection with spaces between the plate pairs of the plate pack, wherein the first plate pack and the second plate pack are disposed adjacent to each other inside the common outer casing, the first plate pack having a diameter, defined by outer edges of the heat exchange plates, which is greater than a diameter of the second plate pack, at least one partition plate being disposed between the first plate pack and the second plate pack, the at least one partition plate having a size which corresponds at least to the size of the plate pack having the greater diameter, the at least one partition plate being elongate from an outer surface of the plate pack to an inner surface of the longitudinal cylindrical shell at one side of the plate pack to form multiple passes for the heat exchange medium in the shell side of the heat exchanger, and wherein the first plate pack and the second plate pack have a common shell side in the heat exchanger arrangement, a single heat exchange medium being configured to flow inside the shell side of the plate heat exchanger arrangement.

2. The plate heat exchanger arrangement according to claim 1, further comprising a third plate pack, which has a diameter, defined by the outer edges of the heat exchange plates, which at least is smaller than a diameter of the first plate pack.

3. The plate heat exchanger arrangement according to claim 2, wherein the first plate pack, the second plate pack, and the third plate pack are disposed adjacent to each other inside the same common outer casing.

4. The plate heat exchanger arrangement according to claim 2, wherein the at least one partition plate includes another partition plate disposed between the third plate pack and the plate pack disposed adjacent thereto.

5. The plate heat exchanger arrangement according to claim 1, wherein one or more of the inlet connection and the outlet connection of the first plate pack is disposed outside of the outer surface of the second plate pack.

6. The plate heat exchanger arrangement according to claim 1, wherein the inlet and outlet connections of the respective first and second plate packs comprise connection pipes that are nested, wherein an outer diameter of an inner connection pipe of the connection pipes is smaller than a diameter of an outer connection pipe of the connection pipes and the flow passage of the respective plate pack.

7. A modular structure comprising:

at least two modules disposed inside a same outer casing, the at least two modules being separated from each other by a partition wall, wherein at least one of the modules is the plate heat exchanger arrangement according to claim 1.

8. The modular structure according to claim 7, wherein the outer casing of the modules is continuous in the length of the modular structure.

9. The modular structure according to claim 7, wherein the partition wall between the plate heat exchanger arrangement and the adjacent module is the end plate of the outer casing of said arrangement.

10. The plate heat exchange arrangement of claim 2, further comprising a third plate pack having a diameter, which is smaller than a diameter of the first plate pack and the second plate pack.

11. The plate heat exchanger arrangement according to claim 3, wherein the at least one partition plate includes another partition plate disposed between the third plate pack and the plate pack disposed adjacent thereto.

12. The plate heat exchanger arrangement according to claim 2, wherein one or more of the inlet connection and the outlet connection of the first plate pack is disposed outside of the outer surface of the second plate pack.

13. The plate heat exchanger arrangement according to claim 3, wherein one or more of the inlet connection and the outlet connection of the first plate pack is disposed outside of the outer surface of the second plate pack.

14. The plate heat exchanger arrangement according to claim 4, wherein one or more of the inlet connection and the outlet connection of the first plate pack is disposed outside of the outer surface of the second plate pack.

15. The plate heat exchange arrangement according to claim 1, wherein one or more of the inlet connection and the outlet connection of the second plate pack is disposed outside of the outer surface of the third plate pack.

* * * * *